US010435265B2

(12) United States Patent
Rasmussen et al.

(10) Patent No.: US 10,435,265 B2
(45) Date of Patent: Oct. 8, 2019

(54) FINISHER OUTPUT BIN ASSEMBLY

(71) Applicant: Hewlett-Packard Development Company, L.P., Houston, TX (US)

(72) Inventors: Steve O Rasmussen, Vancouver, WA (US); Elliott Downing, Vancouver, WA (US); Bruce G Johnson, LaCenter, WA (US); Anthony W Ebersole, Vancouver, WA (US); Ki Jung Han, Vancouver, WA (US); Peter G Hwang, Vancouver, WA (US); Steven Brown, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/760,646

(22) PCT Filed: Dec. 9, 2015

(86) PCT No.: PCT/US2015/064674
§ 371 (c)(1),
(2) Date: Mar. 16, 2018

(87) PCT Pub. No.: WO2017/099745
PCT Pub. Date: Jun. 15, 2017

(65) Prior Publication Data

US 2018/0257899 A1 Sep. 13, 2018

(51) Int. Cl.
*B65H 31/30* (2006.01)
*B65H 31/00* (2006.01)
(Continued)

(52) U.S. Cl.
CPC ..... *B65H 31/30* (2013.01); *B41J 29/00* (2013.01); *B41J 29/13* (2013.01); *B65H 31/00* (2013.01);
(Continued)

(58) Field of Classification Search
CPC .... B65H 31/20; B65H 31/3054; B65H 31/30; B65H 2404/741; B65H 2404/7412;
(Continued)

(56) References Cited

U.S. PATENT DOCUMENTS 5,037,081 A 8/1991 Engelhardt et al.
5,316,279 A 5/1994 Corona et al.
(Continued)

FOREIGN PATENT DOCUMENTS

CN 1715067 1/2006
CN 101364062 2/2009
(Continued)

*Primary Examiner* — Jeremy R Severson
(74) *Attorney, Agent, or Firm* — HP Inc. Patent Department

(57) ABSTRACT

A system for presenting media sheets includes a finisher output bin assembly. The finisher output bin assembly includes a translatable output floor, and a guide substrate coupled to the translatable output floor to guide the translatable output floor relative to the guide substrate in at least one coordinate direction. The finisher output bin assembly includes an output structure mechanically coupled to the translatable output floor to drive the translatable output floor relative to the guide substrate.

15 Claims, 16 Drawing Sheets

(51) Int. Cl.

| | |
|---|---|
| ***B41J 29/00*** | (2006.01) |
| ***B41J 29/13*** | (2006.01) |
| ***B65H 31/02*** | (2006.01) |
| ***B65H 33/08*** | (2006.01) |

(52) U.S. Cl.
CPC ..... *B65H 31/02* (2013.01); *B65H 31/3063* (2013.01); *B65H 33/08* (2013.01); *B65H 2405/1118* (2013.01); *B65H 2405/32* (2013.01); *B65H 2405/351* (2013.01); *B65H 2511/20* (2013.01); *B65H 2511/51* (2013.01); *B65H 2511/515* (2013.01)

(58) Field of Classification Search
CPC .. B65H 2405/1116; B65H 2405/11161; B65H 2405/35; B65H 2405/351; B65H 2405/352; B65H 2405/3521; B65H 31/10
See application file for complete search history.

(56) References Cited

U.S. PATENT DOCUMENTS

| | | | | |
|---|---|---|---|---|
| 5,782,486 | A | 7/1998 | Regimbat Et Ai | |
| 6,231,045 | B1 | 5/2001 | Yamada et al. | |
| 6,283,354 | B1 * | 9/2001 | Hirota | B42C 1/12 227/140 |
| 6,467,769 | B2 | 10/2002 | Boss | |
| 7,377,511 | B2 | 5/2008 | Watanabe et al. | |
| 7,954,808 | B2 * | 6/2011 | Tomida | B65H 31/10 270/58.01 |
| 8,505,911 | B2 * | 8/2013 | Tamada | B65H 31/10 271/213 |
| 8,602,412 | B2 * | 12/2013 | Ma | G03G 15/6552 271/145 |
| 8,622,387 | B2 * | 1/2014 | Kuo | B65H 31/20 271/207 |
| 8,876,106 | B2 * | 11/2014 | Koyama | B65H 31/20 271/215 |
| 9,238,564 | B2 * | 1/2016 | Washino | B65H 1/04 |
| 2002/0158405 | A1 | 10/2002 | Nagasako et al. | |
| 2003/0235484 | A1 | 12/2003 | Aguirre | |
| 2004/0190931 | A1 | 9/2004 | Schuller et al. | |
| 2005/0035522 | A1 | 2/2005 | Gonzalez et al. | |
| 2009/0238623 | A1 | 9/2009 | Kobayashi | |
| 2009/0309296 | A1 | 12/2009 | Taki et al. | |
| 2010/0195119 | A1 | 8/2010 | Shimamura | |
| 2015/0105231 | A1 | 4/2015 | Ishikawa et al. | |
| 2015/0314978 | A1 | 11/2015 | Miyajima | |

FOREIGN PATENT DOCUMENTS

| | | |
|---|---|---|
| CN | 101385325 | 3/2009 |
| CN | 102530628 | 7/2012 |
| EP | 0074481 A1 | 3/1983 |
| JP | 59202882 | 11/1984 |
| JP | 63272750 | 11/1988 |
| JP | 11130334 | 5/1999 |

* cited by examiner

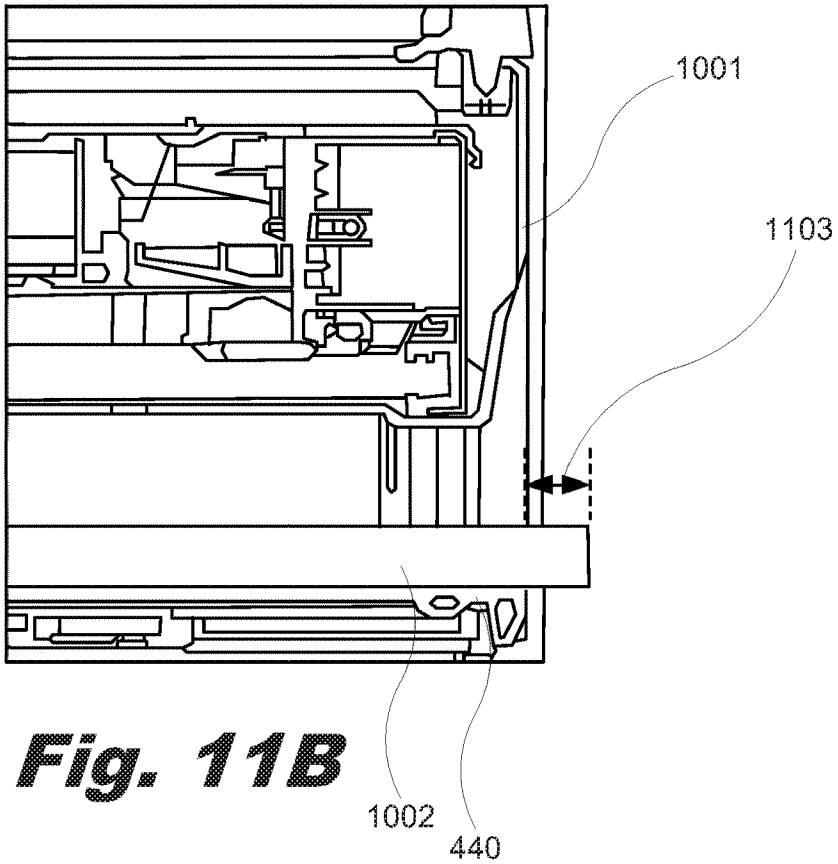
Fig. 11B
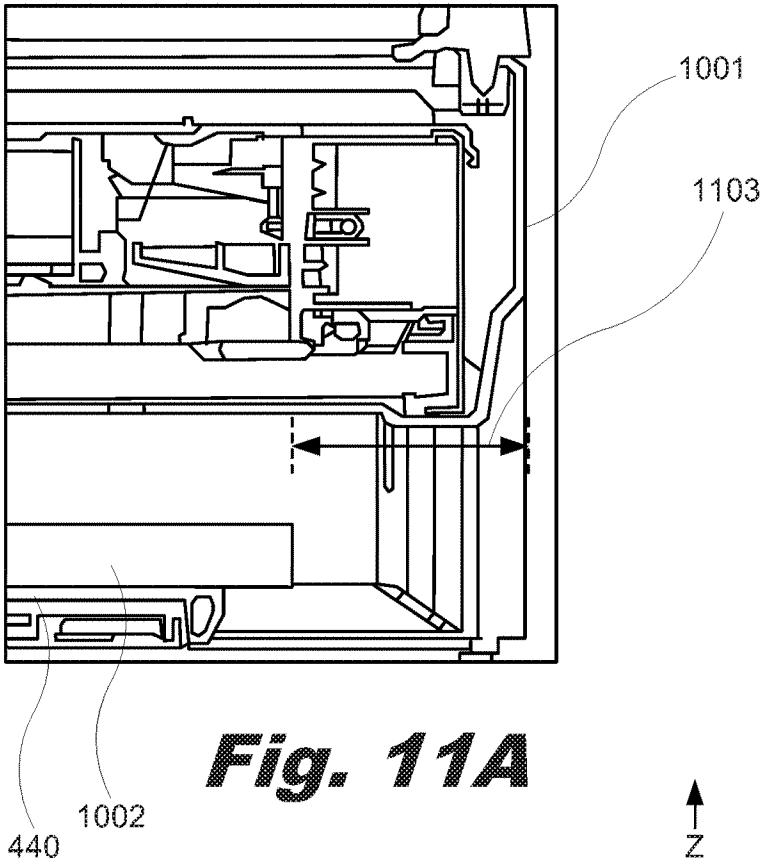
Fig. 11A
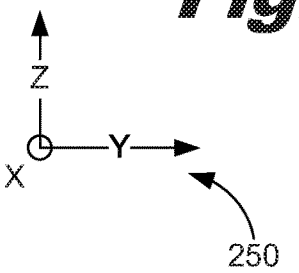

FINISHER OUTPUT BIN ASSEMBLY

BACKGROUND

Printing and copying devices are used to produce physical copies of documents. The printing or copying device produces images and text onto a print target such as a number of media sheets in the case of 2D printing and a bed of build material in the case of 3D printing based on data input to the printing or copying device. In some examples, the printing and copying devices output the printed media sheets to an output tray so that a user may obtain the printed media sheets from a common output area.

BRIEF DESCRIPTION OF THE DRAWINGS

The accompanying drawings illustrate various examples of the principles described herein and are a part of the specification. The illustrated examples are given merely for illustration, and do not limit the scope of the claims.

FIGS. 11A and 11B are cutaway views of the output area of the printing device of FIG. 2 depicting the finisher output bin assembly in a retracted and extended state, respectively, along the Y, Z plane, according to one example of the principles described herein.

Throughout the drawings, identical reference numbers designate similar, but not necessarily identical, elements.

DETAILED DESCRIPTION

Figure 1A:
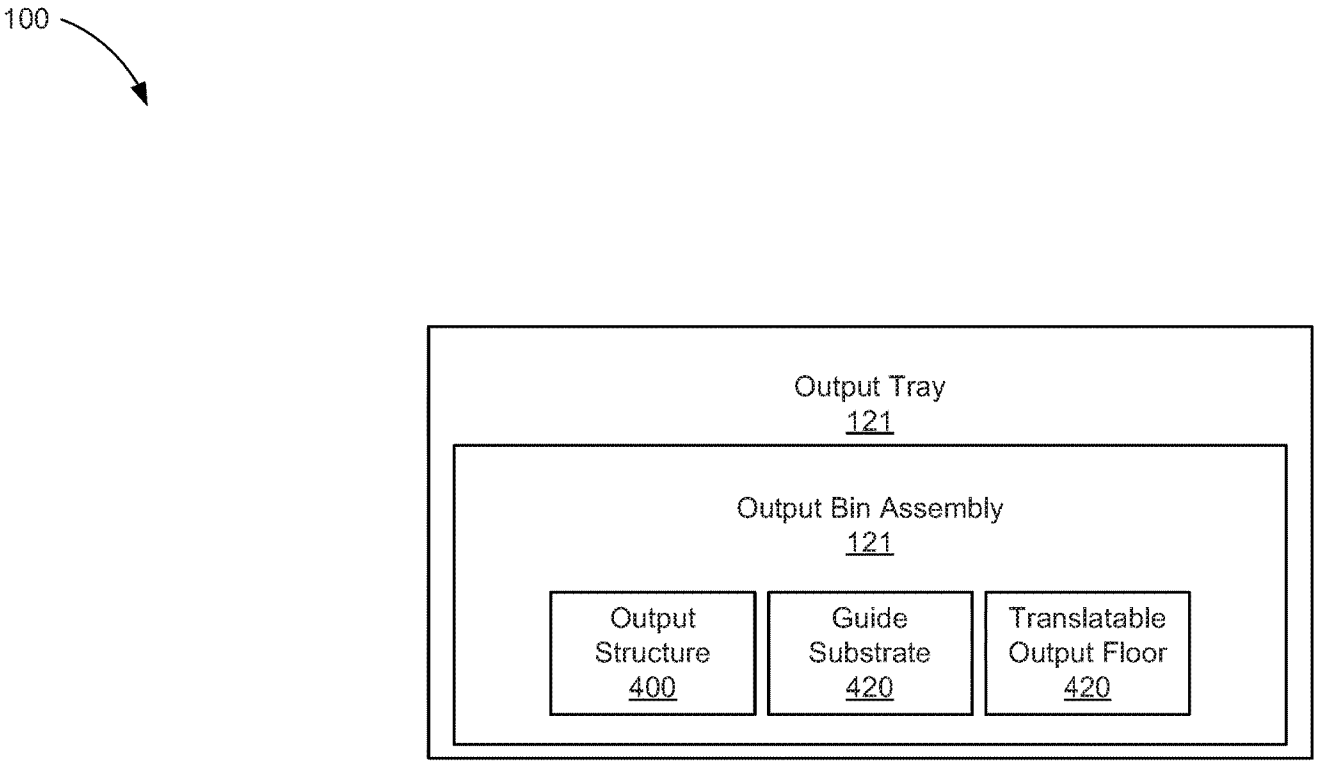
FIG. 1A is a block diagram of a printing device including an output tray, according to one example of the principles described herein.

As mentioned above, printing and copying devices, collectively referred to herein as printing devices, output printed media sheets to a common output tray or other output area. However, in many instances, the printing device outputs the media sheets to an output tray or bin that is visually obscured by one or more portions of the printing device such as protruding portions of the housing of the printing device. Further, design restrictions may result in an output tray or bin that is physically difficult for a user to access finished print jobs. In these situations, a user may not realize that the print job had completed since no visual cues of the printed media sheets is made apparent to the user and since not physical accessibility of the printed media sheets is made available to the user. This can greatly frustrate the user and result in an unfavorable experience with the printing device and its level of functionality and effectiveness.

Further, subjecting printed media sheets to finishing processes such as aligning, stapling and stacking, among other, of un-dried or partially dried inkjet output is a difficult task. Inkjet output may be distorted from curl and cockle. The media may have reduced stiffness from increased moisture content. The surface roughness increases which, in turn, increases the sheet to sheet friction. Some finisher devices and methods simply do not work on partially dried inkjet output. Further, incorporating a finishing device in a printing device may cause additional output trays to be added to the printing device. In some instances, additional output trays may confuse the user, or even obstruct the user's view of output media sheets in any of the output trays and the user's ability to physically access all the output trays to obtain the media sheets due to the physical locations of the output trays relative to one another and the location of the output trays within the printing device. Still further, while a document is aligned and is subjected to a number of finishing processes such as stapling, a user is obliged to wait for completion of the task before seeing or accessing the final document. In contrast, non-finished output is visible and accessible on a sheet-by-sheet basis. Further, aligning and finishing a stack of media sheets also includes printing and accumulating all the media sheets first before the user has an opportunity to see or access the final document.

In fact, vertical layering of a finisher device and output trays may position the output trays at the bottom of the printing device, but inset considerably from the edges of the printing device. This inset places the accessible edges of a finished stack of media sheets back where the media is not visible. Even when viewed from a distance, the media stack may be difficult to identify. Further, in rare cases where the media sheets are visible, hand access by the user may be difficult. Further one output tray may obscure the visibility of output media sheets located in a second output tray.

Examples described herein provide a system for presenting media sheets. The system includes at least one output tray. The output tray includes a finisher output bin assembly including a translatable output floor, a guide substrate coupled to the translatable output floor to guide the translatable output floor relative to the guide substrate in at least one coordinate direction, and an output structure mechanically coupled to the translatable output floor to drive the translatable output floor relative to the guide substrate. In one example, the guide substrate guides the motion of the translatable output floor in a plurality of coordinate directions simultaneously or sequentially. In the example where the guide substrate guides the motion of the translatable output floor in a plurality of coordinate directions, the translatable output floor may be moved in a single direction that is a vector of the plurality of coordinate directions.

The output structure includes a drive motor, and a gear rotatably coupled to the drive motor. A drive reduction system couples the drive motor to the gear to rotate the gear. The guide substrate may also include a number of guide surfaces defined in the guide substrate, and a number of guide pins formed on the translatable output floor. The guide pins movably couple the translatable output floor to the guide substrate. The guide surfaces define the direction of movement of the translatable output floor relative to the guide substrate.

The system may further include a number of rollers coupled to a surface of the guide substrate that interface with the translatable output floor to reduce friction between the guide substrate and the translatable output floor. Further, a number of mirrors may be disposed on the translatable output floor, and a number of sensors may be coupled to the system. The sensors detect the position of the translatable output floor, the presence of media sheets on the translatable output floor, the position of the media sheets on the translatable output floor, a number of offset positions of the translatable output floor, or combinations thereof. The system further includes a controller to control the position of the translatable output floor based at least partially on information provided by the sensors.

Examples described herein further provide a finisher output bin assembly for translating a number of media sheets within an output tray. The finisher output bin assembly includes a guide substrate coupled to a translatable output floor to guide the translatable output floor relative to the guide substrate in at least two coordinate directions. The finisher output bin assembly also includes an output structure including at least one pinion gear protruding through the guide substrate and mechanically coupling to a rack gear formed on the translatable output floor. Further, the finisher output bin assembly includes a drive motor coupled to the pinion gear to drive the translatable output floor relative to the guide substrate.

The finisher output bin assembly further includes a number of track systems defined between the guide substrate and the translatable output floor that define the at least one coordinate direction of movement of the translatable output floor relative to the guide substrate. Again, in one example, the track systems of the output bin assembly define a plurality of coordinate directions of movement of the translatable output floor relative to the guide substrate simultaneously or sequentially. In the example where the track systems define a plurality of coordinate directions of movement, the translatable output floor may be moved in a single direction that is a vector of the plurality of coordinate directions. A retention device may be coupled to the guide substrate to mesh the rack gear with the pinion gear.

Examples described herein further provide a method of providing access to printed media sheets within an output tray. The method includes receiving a number of media sheets on a translatable output floor of a finisher output bin assembly, and translating the media sheets by extending by the finisher output bin assembly in at least one coordinate direction relative to an original position of the finisher output bin assembly. In one example, the translatable output floor may be extended in a plurality of coordinate directions simultaneously or sequentially. In the example where the translatable output floor is extended in a plurality of coordinate directions, the translatable output floor may be moved in a single direction that is a vector of the plurality of coordinate directions.

This method further includes alternating a location of the translatable output floor between a number of positions. In one example, the method may include alternating a location of the translatable output floor between a first offset position and a second offset position to offset consecutive print media stacks. Further, the method includes retracting the translatable output floor to the original position if removal of the media sheets is detected by a number of sensors, and maintaining the translatable output floor in the extended position if the media sheets are detected on the translatable output floor by the sensors. Still further, the method includes retracting the translatable output floor to the original position if additional stacks of media sheets are outputted to the output tray.

As used in the present specification and in the appended claims, the term "coordinate direction" or similar language is meant to be understood broadly as a first direction relative to a second direction where the first and second directions extend from an origin at a 90 degree angle relative to one another. For example, the X-direction is perpendicular or 90 degrees relative to the Y-direction.

As used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Turning now to the figures,

FIG. 1A is a block diagram of a printing device (100) including an output tray, according to one example of the principles described herein. The printing device (100) includes an output tray (121) to receive a number of stacks of media sheets. The output tray (121) includes a finisher output bin assembly (201) that includes an output structure (400), a guide substrate (420), and a translatable output floor (440). The output structure (400), guide substrate (420), and translatable output floor (440) of the output bin assembly (201) translate printed media sheets to a second location within the output tray (121) so that a user of the printing device (100) may be made visually aware that the printing device (100) produced the printed media sheets, and to provide the user with physical access to the printed media sheets. Details regarding the function of these elements will be provided in more detail below.

Figure 1B:
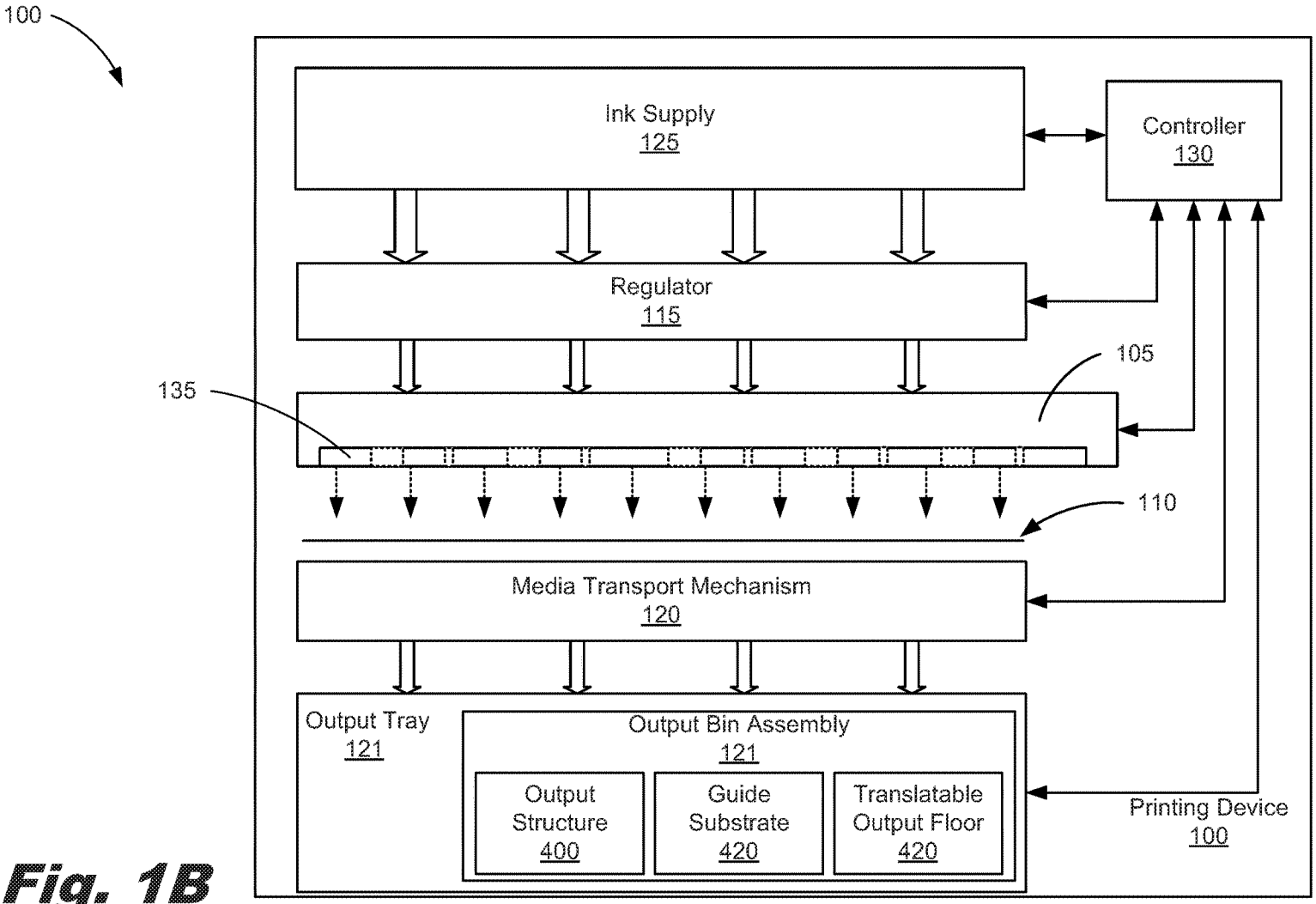
FIG. 1B is a block diagram of a printing device including an output tray, according to another example of the principles described herein.

FIG. 1B is a block diagram of a printing device (100) including an output tray (121), according to another example of the principles described herein. The printing device (100) may include a print bar (105) that, in one example, spans the width of a print media (110). In another example, the printing device (100) may include non-page wide array printheads. The printing device (100) may further include flow regulators (115) associated with the print bar (105), a media transport mechanism (120), printing fluid or other ejection fluid supplies (125), and a printer controller (130). Although a 2D printing device I described throughout and depicted in the accompanying figures, aspects of the examples described herein may be applied in a 3D printing device.

The controller (130) may represent the programming, processor(s), associated data storage device(s), and the electronic circuitry and components used to control the operative elements of a printing device (100) including the firing and operation of the printheads (135) included in the print bar (105). Further, the controller (130) controls the media transport mechanism (120) used to transport media through the printing device (100) during printing and to transport the media sheets to the output tray (121). In one example, the controller (130) may control a number of functions of the output tray (121) in presenting the media sheets to an output floor of the output tray (121). Still further, the controller (130) controls functions of a finisher output bin assembly (FIG. 2, 201) used to translate a number of stacks of media sheets between a number of different locations within the output area.

The media transport mechanism (120) may transport media sheets from the printing device to the output tray (121) for collection, registration, and, in some examples, finishing of the media sheets. In one example, the media sheets collected in the output tray (121) include at least one media sheet on which the printing device has produced text and/or images. In one example, a completed collection of media sheets may represent a print job that the printing device processes.

The printing device (100) may be any type of device that reproduces an image onto a sheet of print media. In one example, the printing device (100) may be an inkjet printing device, laser printing device, a toner-based printing device, a solid ink printing device, a dye-sublimation printing device, among others. Although the present printing device (100) is described herein as an inkjet printing device, any type of printing device may be used in connection with the described systems, devices, and methods described herein. Consequently, an inkjet printing device (100) as described in connection with the present specification is meant to be understood as an example and is not meant to be limiting.

Figure 2:
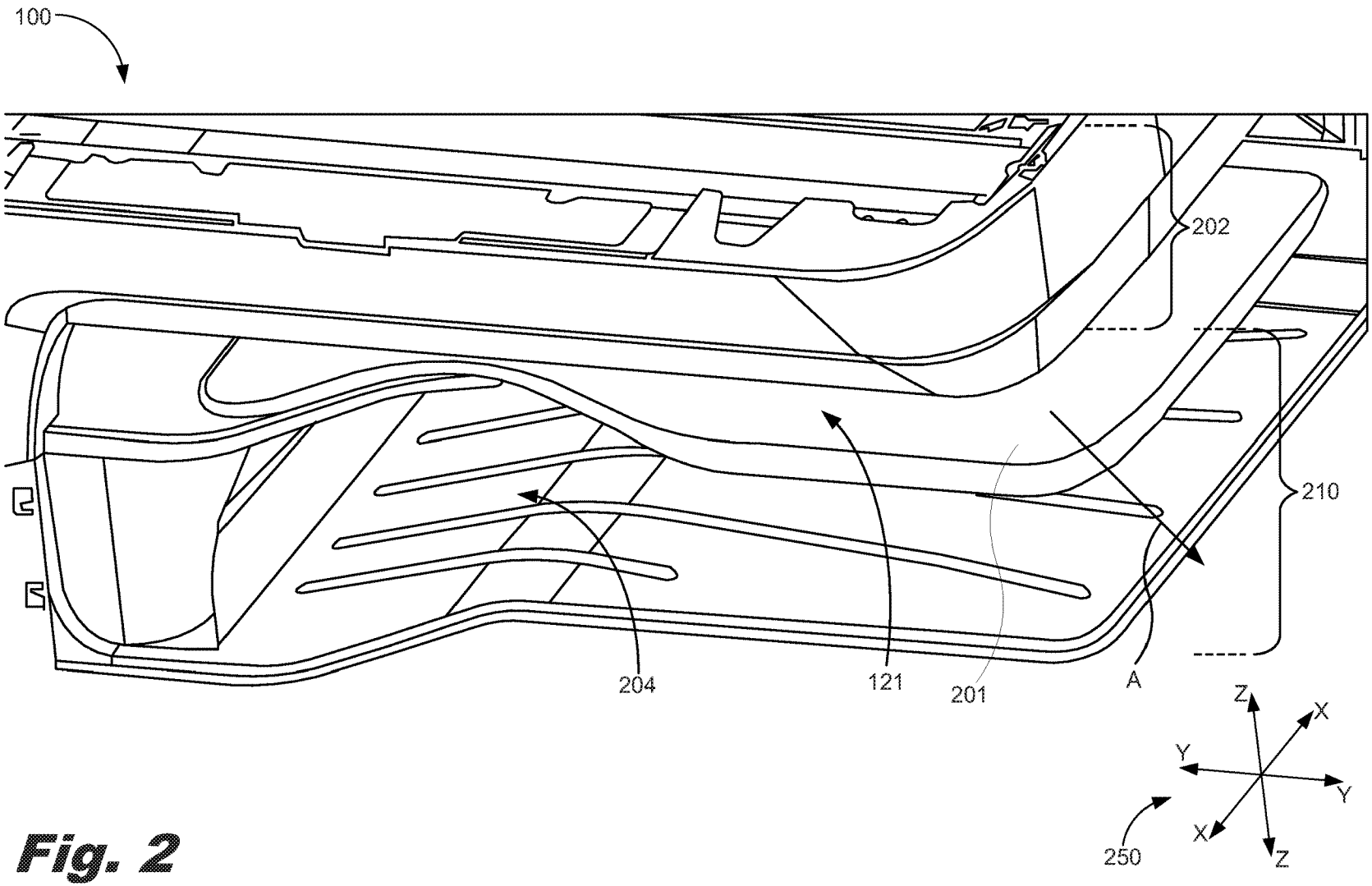
FIG. 2 is an isometric view of an output area of the printing device of FIG. 1, according to one example of the principles described herein.

The output tray (121) as depicted in FIGS. 1A and 1B will now be described in connection with FIGS. 2 through 15. FIG. 2 is an isometric view of an output area (210) of the printing device (100) of FIG. 1, according to one example of the principles described herein. In one example, the printing device (100) includes a number of output trays (121, 204) within the output area (210). A first output tray (204) may be an output tray reserved for non-collated print jobs that comprise a plurality of printed media sheets not subjected to alignment process, a stapling process. a hole punching process, a binding process, embossing process, a gluing process, or another finishing process. The second output tray (121) may be used to receive media sheets that have been collated, subjected to a finishing process, or a combination thereof, and includes a finisher output bin assembly as will be described in more detail herein. Even though the first output tray (204) is depicted in the printing device (100) of FIG. 2, the first output tray may not be included in one example. In this example, the second output tray (121) is included and is used as the output tray for both finished and unfinished media sheets.

The output area (210) of the printing device (100) further includes a finisher device (202) located above the output tray (121). The finisher device (202) includes elements and devices that assist in performing a number of finishing processes including, for example, alignment processes, a stapling process, a hole punching process, a binding process, an embossing process, a gluing process, other finishing processes, or combinations thereof. The media sheets are transported through the finisher device (202), and are deposited onto a finisher output bin assembly (201) located within the second output tray (121). In FIG. 2, the finisher output bin assembly (201) is depicted in an extended state where the finisher output bin assembly (201) moves in the Y direction to the right and the X direction towards the front of the printing device (100) as indicated by arrow A.

Throughout the figures, a three-dimensional Cartesian coordinate indicator (250) is depicted to orient the reader as to directions of movement and forces placed on and interaction between the various elements within the output tray (121) of the printing device (100). As depicted in FIG. 2, a user may approach the printing device (100) from the front as indicated by the Y, Z plane. Further, an X, Z plane to the far right of the printing device (100) depicted in FIG. 2 is the right-hand side of the printing device (100) where printed media sheets are output from the printing device (100).

Figure 3:
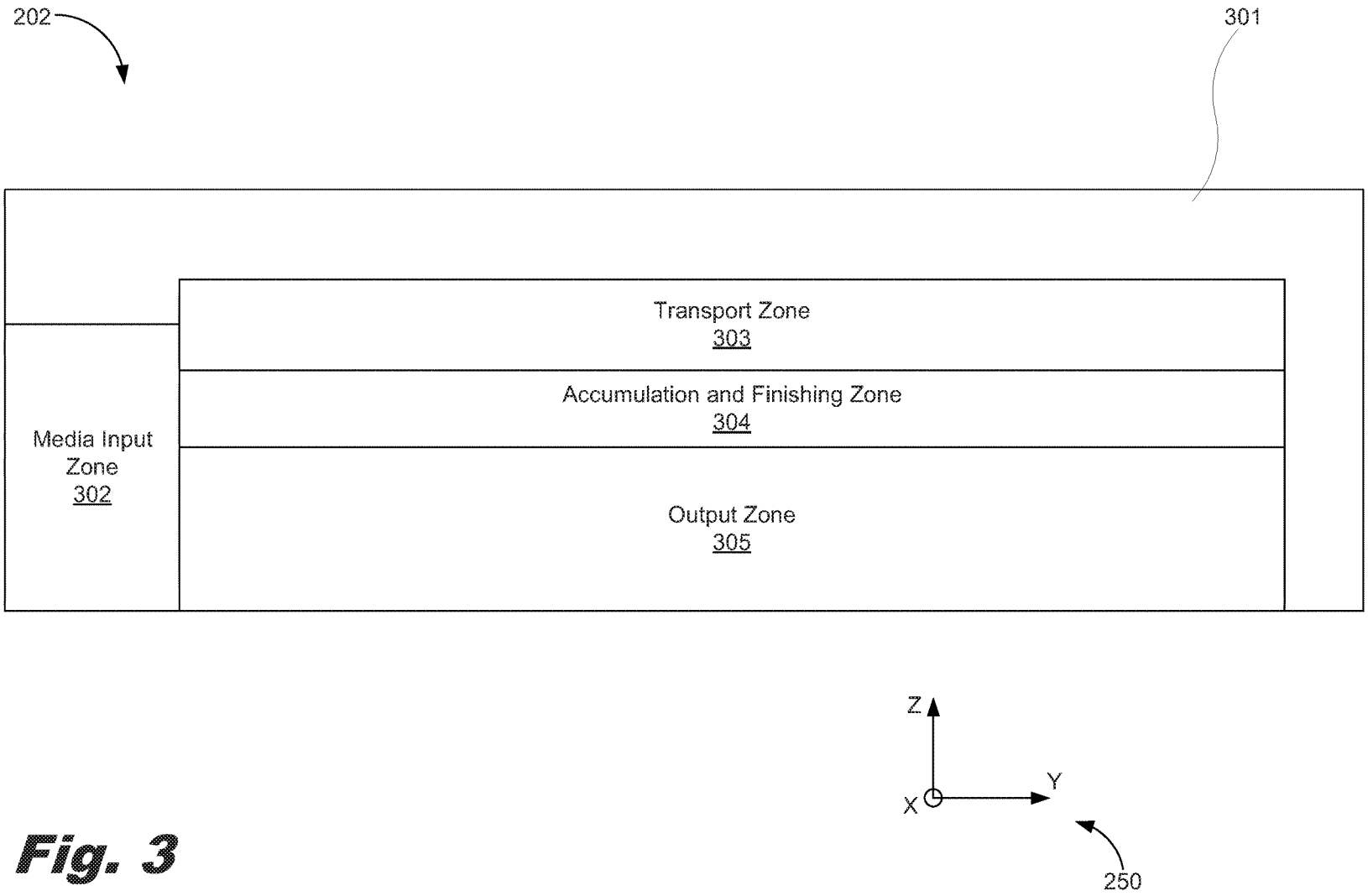
FIG. 3 is a block diagram of the media path of sheets of media of the printing device of FIG. 1, according to one example of the principles described herein.

FIG. 3 is a block diagram of the media path of sheets of media of the printing device (100) of FIG. 1, according to one example of the principles described herein. The user initiates a print job, and the printing device (100) executes that print job by creating printed media sheets. These printed media sheets are output from a printing section of the printing device (100) into a media input zone (302) of a finisher device (202), and are introduced to a transport zone (303). The transport zone (303) transports the media sheets to an accumulation and finishing zone (304). As mentioned above, the accumulation and finishing zone (304) accumulates a number of printed media sheets, and performs a number of finishing processes on the accumulated media sheets. The accumulated media sheets may be referred to herein as a stack of media sheets, and may represent the print job executed by the printing device (100) based on the user's input and instructions. The stacks of media sheets are finished one at a time within the accumulation and finishing zone (304), and a number of stacks of media may be output to an output zone (305) and deposited on the finisher output bin assembly (201) for presentation to a user of the printing device (100).

Figure 4:
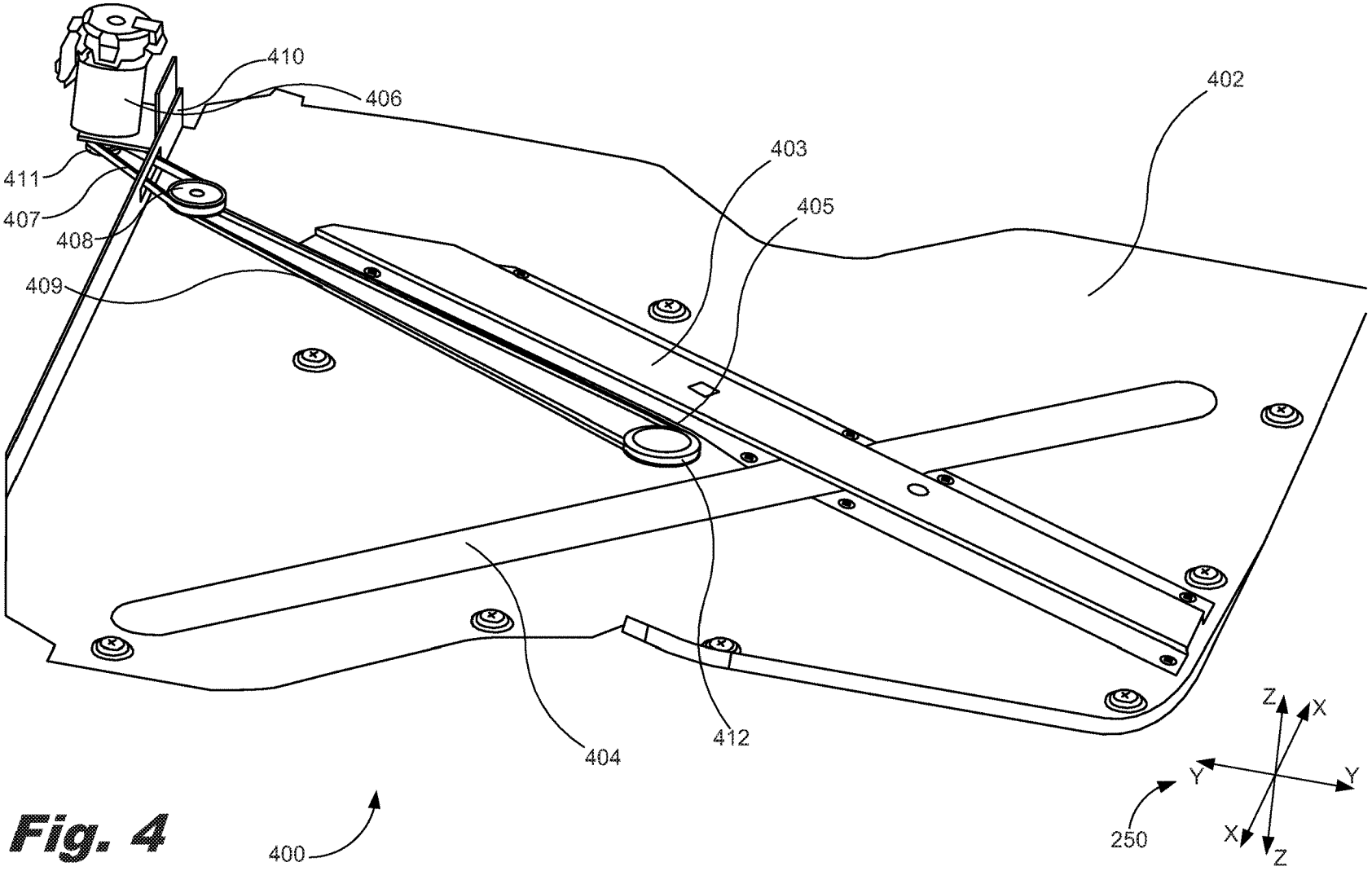
FIG. 4 is an isometric view of an output structure of a finisher output bin assembly, according to one example of the principles described herein.
Figure 5:
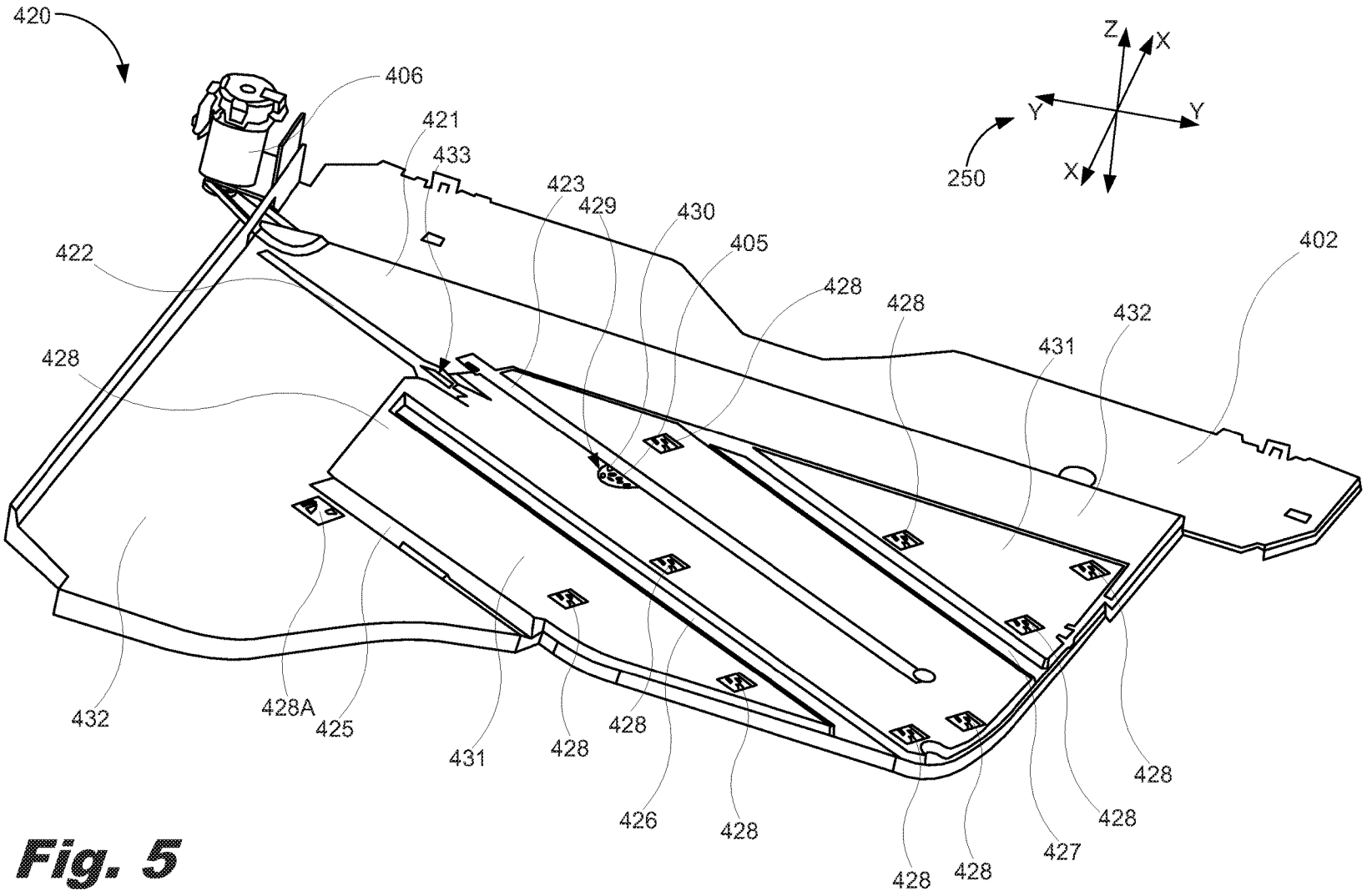
FIG. 5 is an isometric view of a guide substrate of a finisher output bin assembly, according to one example of the principles described herein.
Figure 6:
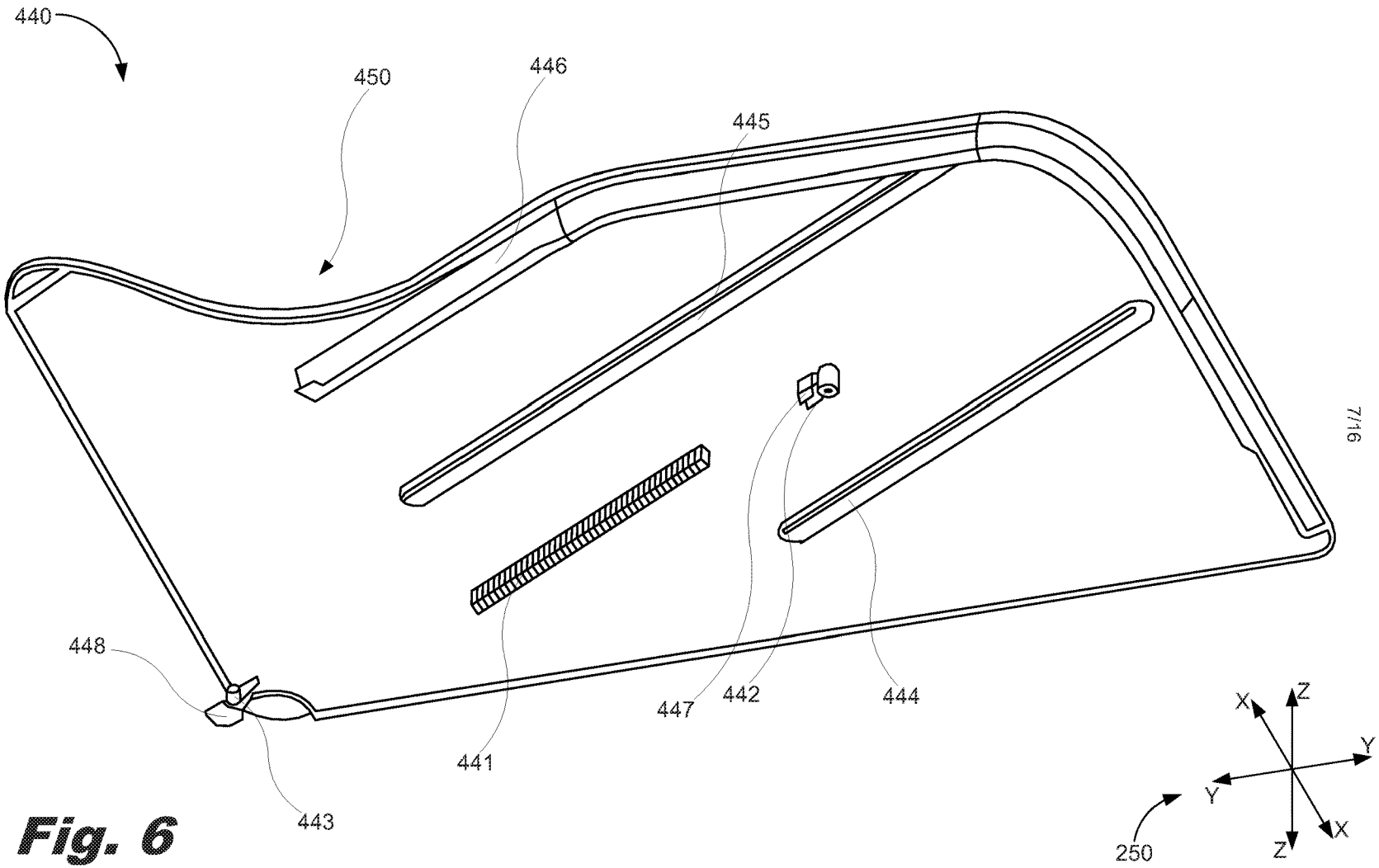
FIG. 6 is an isometric view of a bottom of a translatable output floor that is coupled to the guide substrate of FIG. 5 of a finisher output bin assembly, according to one example of the principles described herein.

Details regarding the finisher output bin assembly (201) will now be provided in connection with FIGS. 4 through 6. FIG. 4 is an isometric view of an output structure (400) of a finisher output bin assembly (201), according to one example of the principles described herein. FIG. 5 is an isometric view of a guide substrate (420) of a finisher output bin assembly (201), according to one example of the principles described herein. FIG. 6 is an isometric view of a bottom of a translatable output floor (440) that is coupled to the guide substrate (420) of FIG. 5 of a finisher output bin assembly (201), according to one example of the principles described herein. Beginning with the output structure (400) depicted in FIG. 4, a number of cross-bars (403, 404) may be coupled to or formed into the base plate (402) to provide rigidity to the output structure (400) and the finisher output bin assembly (201) as a whole. In one example, the base plate (402) is made of sheet metal.

The output structure (400) is coupled to an infrastructure of the printing device (100) via a coupling wall (410), via the base plate (402), or a combination thereof. The coupled position of the output structure (400) relative to the printing device (100) defines where media sheets are deposited on the finisher output bin assembly (201). Therefore, in the examples describe herein, the output structure (400) is coupled to the printing device (100) below accumulation and finishing zone (304) included within the finisher device (202) since the finisher device (202) deposits the media sheets in the Z-direction below the finisher device (202) into the output zone (305) that includes the finisher output bin assembly (201).

A drive motor (406) is coupled to the coupling wall (410). In one example, the drive motor (406) is positioned outside the finisher device (202). The drive motor (406) provides the force to move the translatable output floor (440) relative to the guide substrate (420) as will be described in more detail below. In one example, the drive motor is a servomotor in order to utilize the precision provided by the servomotor. However, in another example, the drive motor may be a stepper motor or another type of drive motor.

At least one drive belt (407, 409) mechanically couples the drive motor (406) to at least one gear (405). However, in another example, the drive system of the guide substrate (420) may include all gears and no belts to transmit power to the gear (405). In the example of FIG. 4, a first drive belt (407) is coupled between the drive motor (406) and a reduction wheel (408). A second drive belt (409) is coupled between the reduction wheel (408) and the gear (405). In this example, the first drive belt (407), reduction wheel (408), and second drive belt (409) form a two-stage belt reduction system. The diameters of a drive wheel (411) of the drive motor (406), the reduction wheel (408), and a belt interface (412) of the gear (405) define a desired the output speed of the gear (405) and the level of torque provided by the gear (405). In one example, the output speed and torque of the two-stage belt reduction system provides a user with a timely presented stack of media sheets while also functioning in a manner that creates an impression of a smooth and precisely functioning printing device (100). In one example, any number of gears, pulleys, or a combination thereof may be used within the two-stage belt reduction system.

Turning to FIGS. 5 and 6, the guide substrate (420) is coupled to the output structure (400). The guide substrate (420) includes a gear aperture (429) that allows the gear (405) of the output structure (400) to protrude through the gear aperture (429) and interface with a rack (441) coupled to or formed on the translatable output floor (440) as depicted in FIG. 6. The guide substrate (420) further includes a number of rollers (428, 428A) that reduce or eliminate friction between the guide substrate (420) and the translatable output floor (440). In one example, the rollers (428, 428A) each include a shaft coupled to the guide substrate (420) and a wheel coupled to the shaft. In this manner, the rollers freely rotate as the translatable output floor (440) slides with respect to the guide substrate (420). In order to house the rollers (428), the guide substrate includes a sub-plate (431) formed with a main plate (432). The main plate (432) includes a recessed portion in which the sub-plate (431) is formed. When the sub-plate is formed within the recess of the main plate (432), the elevation of the two surfaces is approximately equal. In one example, the rollers (428) may be coupled to the sub-plate (431), and housed between the sub-plate (431) and the main plate (432). In another example, the coupling of the translatable output floor (440) to the guide substrate (420) retains the rollers (428) within the system. In still another example, the rollers (428) snap into seating retainers formed in the guide substrate (420). A number of rollers (428A) may be included on the main plate (432) as well. In one example, the rollers (428A) coupled to the main plate (432) may be raised to match the height of the rollers (428) disposed on the sub-plate (431).

Turning now to both FIGS. 5 and 6, the guide substrate (420) further includes a number of guide recesses (422, 423, 425, 426, 427) that interface with a number of guide pins (442, 443) and a number of guide protrusions (444, 445, 446) coupled to or formed on the bottom of the translatable output floor (440). First, the guide pins (442, 443) interface with guide recesses (422, 423). As depicted in FIGS. 5 and 6, the guide pins (442, 443) include retainers (447, 448) that, during manufacture, for example, are coupled to the guide recesses (422, 423). In one example, the retainers (447, 448) include flexible snap arms that are biased in an outward direction from one another. The flexible snap arms of the guide recesses (422, 423) deflect inwardly towards one another and snap into and interface with channels defined along both sides of the length of the guide recesses (422, 423). In one example, a number of apertures (433) that allow the retainers (447, 448) to fit into the channels defined in the guide recesses (422, 423). In this manner, the retainers (447, 448) slidably couple the translatable output floor (440) to the guide substrate (420). However, any coupling process or device may be used to slidably couple the translatable output floor (440) to the guide substrate (420). Guide recess (423) is defined within the guide substrate (420) to provide clearance to the rack in connection with the retention device (430) disposed within the guide recess (423).

The remainder of the guide recesses (425, 426, 427) defined on the guide substrate (420) interface with the remainder of the guide protrusions (444, 445, 446) coupled to or formed on the translatable output floor (440). The interface between the guide recesses (425, 426, 427) and guide protrusions (444, 445, 446) serve to ensure that the movement of the translatable output floor (440) relative to the guide substrate (420) does not shift from an intended direction of movement as defined by the position and direction of the guide recesses (422, 423, 425, 426, 427).

In one example, the translatable output floor (440) includes a cutaway (450) defined in the side thereof. With reference to FIG. 2, the translatable output floor (440) of the finisher output bin assembly (201) is depicted since it is the top-most element of the finisher output bin assembly (201). As depicted in FIG. 2, the cutaway (450) serves to provide the user with a direct line of sight to at least a portion of the first output tray (204) located below the second output tray (121) in which the finisher output bin assembly (201) is located. This allows for the user to readily see and access printed media sheets that are output to the first output tray (204). As described herein, the finisher output bin assembly (201) translates printed media sheets that are output to the second output tray (121) to provide visual and tangible access to the printed media sheets dispensed therein. Thus, in this manner, a user may readily see and have access to printed media sheets regardless of which output tray (121, 204) the printed media sheets are output when the finisher output bin assembly (201) is in either a retracted state or an extended state because of the cutaway (450). In one example, sheets of media may be output to the first output tray (204) such that they are biased in the negative Y-direction to the left as depicted in FIG. 2. This may be achieved using, for example, an inclined output tray floor in the first output tray (204), a media feed path upstream from the first output tray (204) that ensures left biasing, or another mechanism that biases the media sheets to the left. In contrast, the media sheets output to the first output tray (204) and onto the finisher output bin assembly (201) may be biased in the positive Y-direction to the right as depicted in FIG. 2. In this manner, media sheets output in the two output trays (121, 204) are visually and spatially separated in order to assist a user in deciphering between the two outputs.

Turning again to the interfacing between the guide substrate (420) and the translatable output floor (440) and FIGS. 5 and 6, the gear (405) meshes with the rack (441) to form a rack and pinion gear set. Rack and pinion gear sets include a circular gear called a pinion such as gear (405) that engages equally spaced teeth of a linear gear called a rack such as rack (441) to convert rotational motion to linear motion. While the example of FIG. 4 includes a rack to provide linear motion, any alternative motion may be achieved by including a combination of any number of curved output toothed devices and straight racks operating together with a number of appropriately-shaped guide recesses (422, 423, 425, 426, 427).

In the example of FIG. 4, the pinion (405) is meshed with the rack (441), and the linear nature of the gear rack (441) converts the pinion's (405) rotary motion into linear motion. In this manner, a rack (441) and pinion gear (405) may be used as a linear actuator to move the translatable output floor (440) relative to the guide substrate (420). Because rack and pinion sets have relatively few components, they help save time in manufacturing and installation, increase reliability, and provide high levels of accuracy even over long travel lengths. In order for the rack (441) and pinion (405) gears to work together or mesh, they include compatible features such as diametral pitch and pressure angle.

In one example, a retention device (430) may be included in the guide substrate (420) to ensure that the rack (441) engages and meshes with the pinion gear (405). In this example, the retention device (430) is included within guide recess (423), and narrows the space within the guide recess (423) to provide a constant force on the rack (441) to push the rack (441) into engagement with the pinion gear (405) and to ensure that the rack (441) and pinion gear (405) do not disengage and cause damage to the rack (441) or pinion gear (405), or cause the finisher output bin assembly (201) to malfunction.

In one example, the translatable output floor (440) includes a number of relatively higher friction elements or a relatively higher friction coating on at least a portion of the top surface of the translatable output floor (440). This friction coating enables the translatable output floor (440) to carry stacks of media sheets without the media sheets slipping along the top surface of the translatable output floor (440). For example, if the translatable output floor (440) is made of a plastic or metal, is may be possible that the media sheets may move relative to their original deposition location over the surface of the translatable output floor (440). The relatively higher friction elements or coating cause the stack of media sheets to remain in the original deposition location during translation of the stack to the extended position of the translatable output floor (440).

Figure 7:
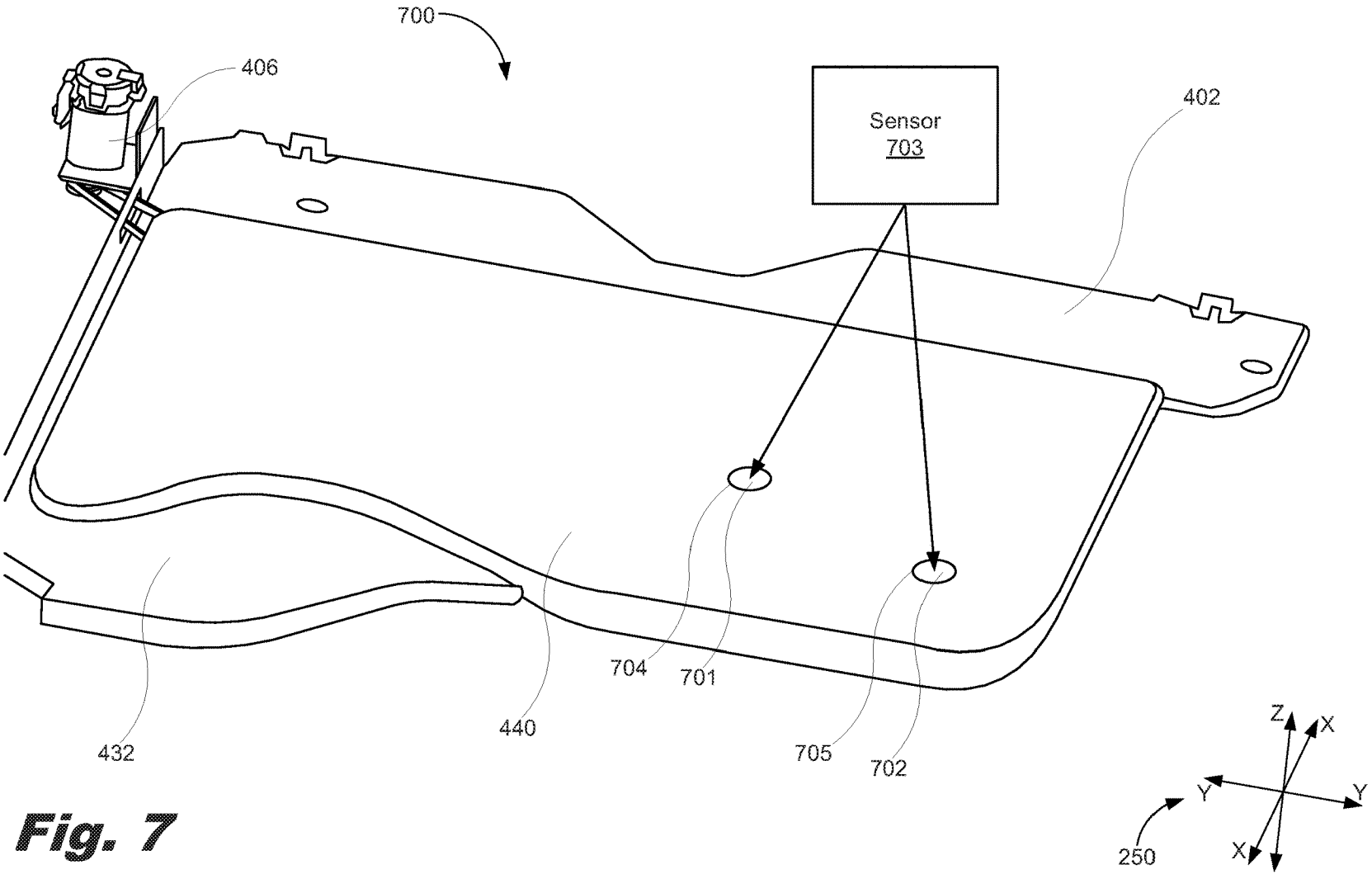
FIG. 7 is a top isometric view of a finisher output bin assembly including and depicting the translatable output floor in a retracted state of FIG. 2 depicting a number of mirrors, according to one example of the principles described herein.
Figure 8:
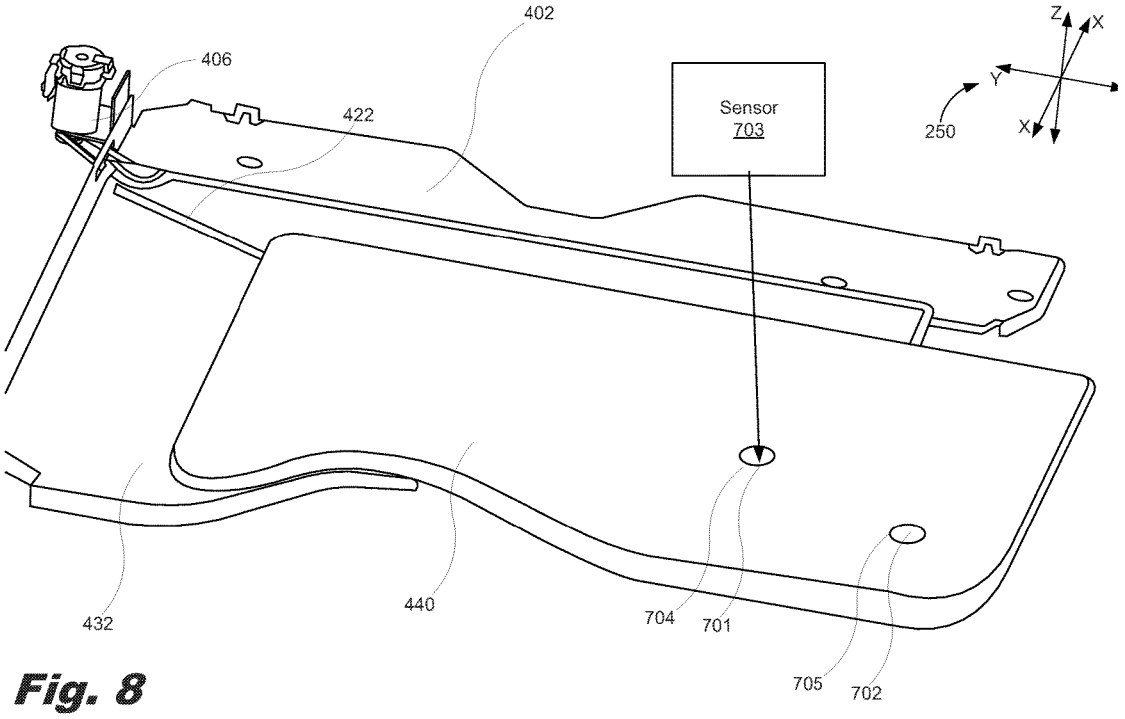
FIG. 8 is a top isometric view of the finisher output bin assembly of FIG. 2 depicting the finisher output bin assembly in an extended state, according to one example of the principles described herein.

Determining the state of the finisher output bin assembly (201) and the location of the translatable output floor (440) will now be described in connection with FIGS. 7 and 8. FIG. 7 is a top isometric view of a finisher output bin assembly (700) including and depicting the translatable output floor (440) in a retracted state of FIG. 2 depicting a number of mirrors (701, 702), according to one example of the principles described herein. FIG. 8 is a top isometric view of the finisher output bin assembly (201) of FIG. 2 depicting the finisher output bin assembly (201) in an extended state, according to one example of the principles described herein. In one example, the mirrors (701, 702) are coupled to a corresponding number of recesses (704, 705) defined in the translatable output floor (440). The sensor (703) may be included within any portion of the printing device (100). In one example, the sensor (703) is embedded in a bottom surface of the finisher device (202) so as to be hidden from a user, and to provide the sensor with direct line of sight of the mirrors (701, 702). With the movement of the translatable output floor (440), the sensor detects the position of the mirrors (701, 702) and whether the mirrors (701, 702) are obscured by an object like at least one stack of media. This information is used by, for example, the controller (130) to signal movement of the translatable output floor (440) as described herein.

More specifically, the sensor (703) and mirrors (701, 702) are used to detect the position of the translatable output floor (440), the presence of media sheets on the translatable output floor (440), a number of offset positions of the translatable output floor (440), or combinations thereof. As will be described in more detail below in connection with FIGS. 14 and 15, a series of determinations are made as to whether to move the translatable output floor (440) to an extended position, retract the translatable output floor (440) to a home or retracted position, or position the translatable output floor (440) at an intermediary media offsetting position based on the sensor (703) detecting the mirrors (701, 702) at various locations along the extension path of the translatable output floor (440).

As depicted in FIG. 8, when the translatable output floor (440) is moved, the sensor (703) can no longer detect at least one of the mirrors (701, 702) in a position indicative of a home or original position. Instead, the sensor (703) identifies the translated location of the mirrors as being an offset position where the translatable output floor (440) is in one of a number of offset positions as described herein, an extended position where the translatable output floor (440) is extended, or an intermediary position. Further, the sensor (703) detects the obstruction of the mirrors (701, 702) by stacks of media sheets, and uses this information to determine whether to extend the translatable output floor (440) in order to allow a user to visually detect and access the stack of media sheets on top of the translatable output floor (440).

Figure 9:
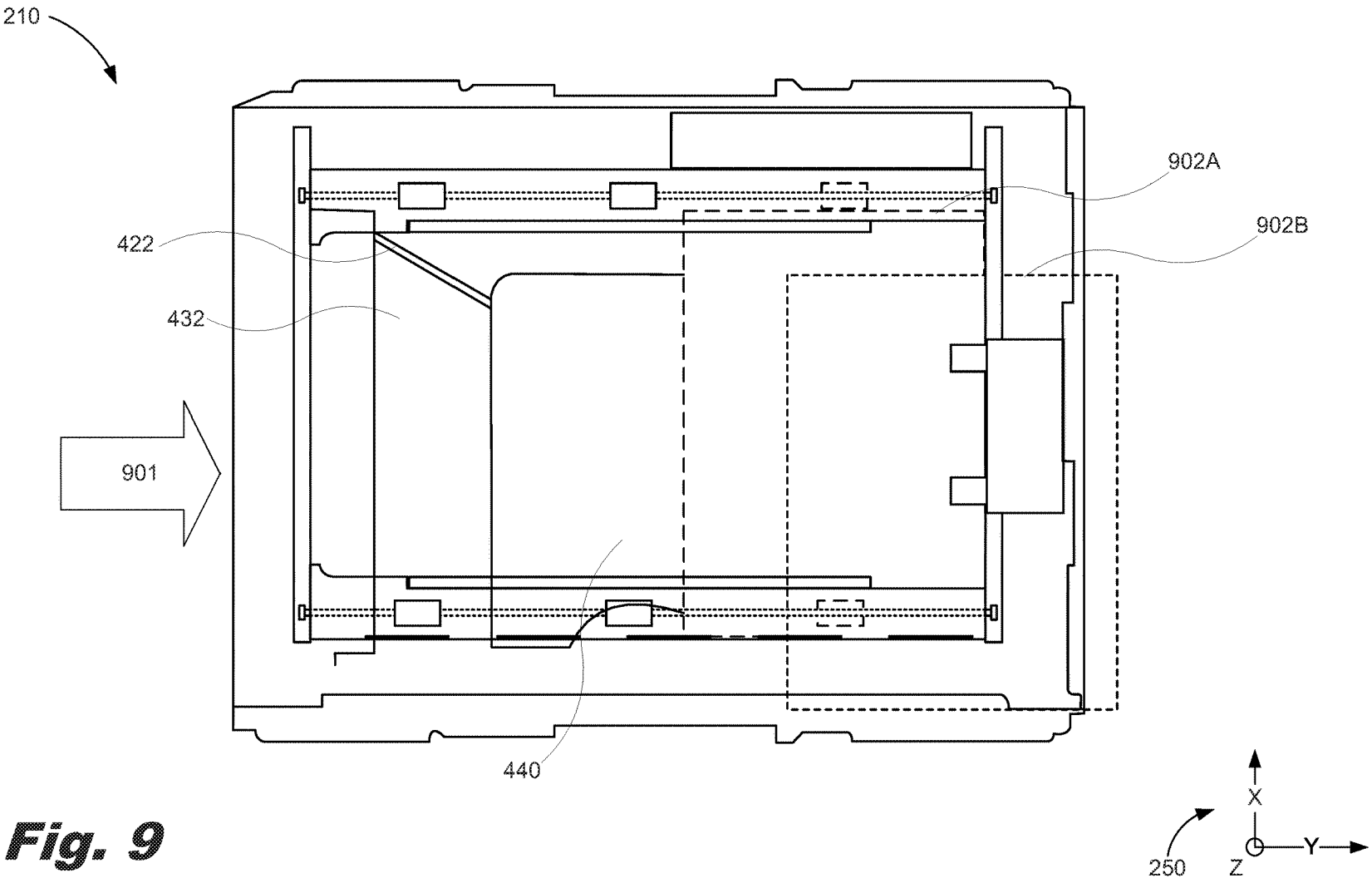
FIG. 9 is a top view of the output area of the printing device of FIG. 2 depicting the finisher output bin assembly of FIGS. 4 through 6 in an extended state and translation of media sheets, according to one example of the principles described herein.

Moving on, FIG. 9 is a top view of the output area (210) of the printing device (100) of FIG. 2 depicting the finisher output bin assembly (201) of FIGS. 4 through 6 in an extended state and translation of media sheets thereon, according to one example of the principles described herein. The media sheets (902A, 902B) enter the output area (210) from the left of the figure as designated by arrow (901), moved within and processed by the finisher device (202), and dropped onto the translatable output floor (440) of the finisher output bin assembly (201) at a first location (902A).

In order to provide visual and physical access to the stack of media sheets (902A), the drive motor (406) of the output structure (400) is activated by the controller (130), and the translatable output floor (440) moves relative to the guide substrate (420) to a second, extended position (902B). The second extended position is depicted in FIG. 9, and is relatively further to the right and towards the front of the output area (210) of the printing device. Thus, as the translatable output floor (440) moves in a diagonal direction away from its home or original position, it is moving in the positive Y and negative X directions as indicated by the Cartesian coordinate indicator (250). In this manner, the finisher output bin assembly (201) is moved to a position where the user can see and physically access the stack or stacks of printed media sheets (902B).

Figure 10B:
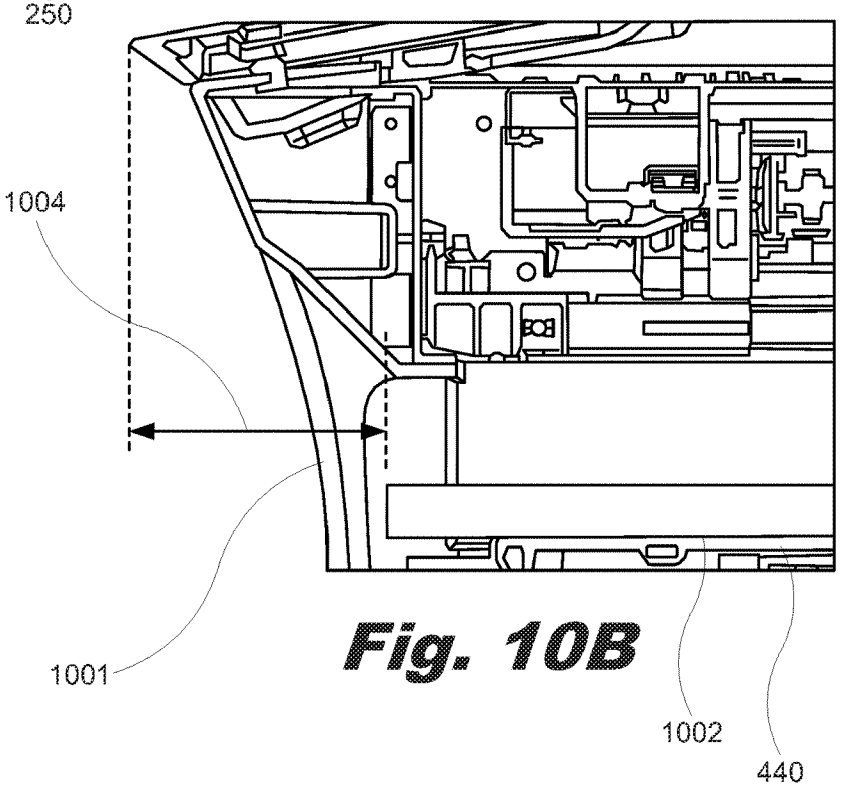
FIGS. 10A and 10B are cutaway views of the output area of the printing device of FIG. 2 depicting the finisher output bin assembly in a retracted and extended state, respectively, along the X, Z plane, according to one example of the principles described herein.
Figure 10A:
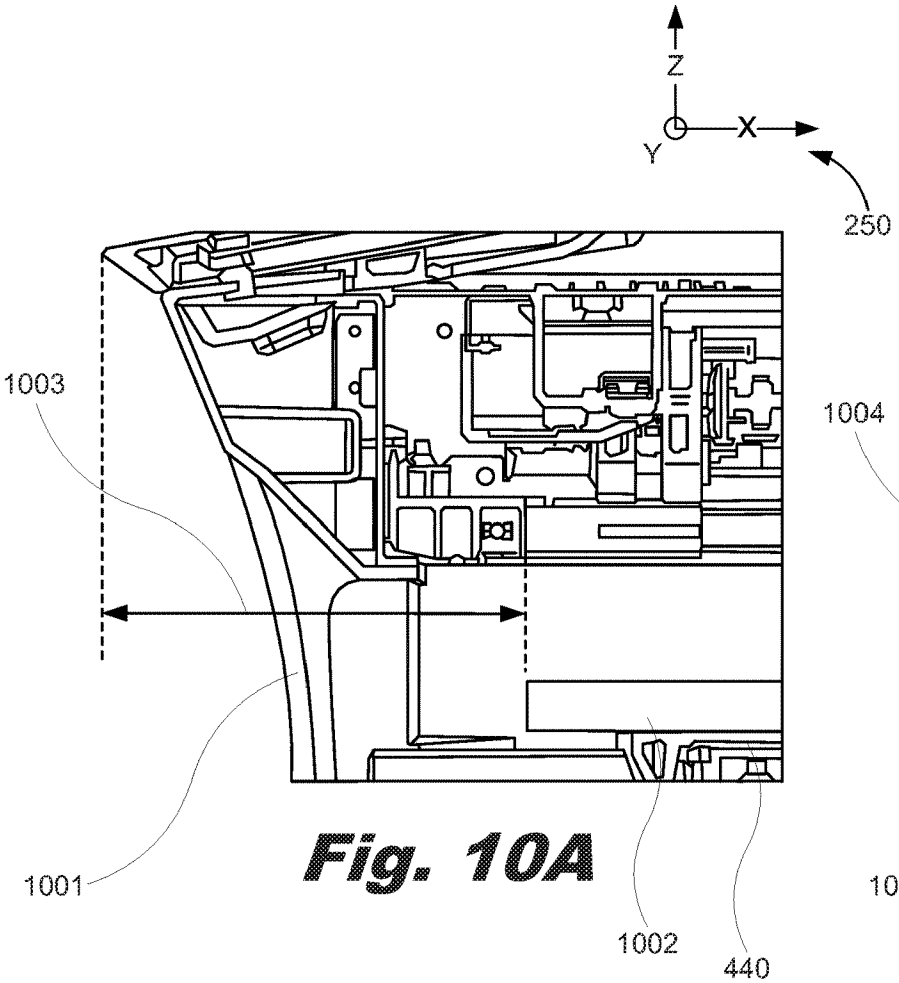

The extent at which the finisher output bin assembly (201) is able to move the stacks of media sheets will now be described in connection with FIGS. 10A, 10B, 11A, and 11B. FIGS. 10A and 10B are cutaway views of the output area (210) of the printing device (100) of FIG. 2 depicting the finisher output bin assembly (201) in a retracted and extended state, respectively, along the X, Z plane, according to one example of the principles described herein. FIGS. 11A and 11B are cutaway views of the output area (210) of the printing device (100) of FIG. 2 depicting the finisher output bin assembly (201) in a retracted and extended state, respectively, along the Y, Z plane, according to one example of the principles described herein. Beginning with FIGS. 10A and 10B, the housing (1001) of the printing device (100) is depicted, and relative positions of the stack of media sheets (1002) are also depicted. In the retracted state depicted in FIG. 10A, the stack of media sheets (1002) are located a first distance (1003) under various elements of the printing device (100) and relatively out of view of the user in the positive X direction as indicated by the Cartesian coordinate indicator (250). In one example, the distance (1003) is approximately 130 mm from the outer-most edge of the housing (1001).

In order to place the stack of media sheets (1002) in a viewable and obtainable position, the translatable output floor (440) of the finisher output bin assembly (201) is moved some distance in the negative X direction as depicted in FIG. 10B. This results in the stack of media sheets (1002) being located a second distance (1004) relative to the various elements of the printing device (100), and within view and in an obtainable position relative to the position depicted in FIG. 10A. In one example, the second distance (1004) is approximately 76 mm, resulting in approximately 54 mm of translation of the stack of media sheets (1002) in the negative X direction. This greatly improves the visibility and access of the stack of media sheets (1002) for the user.

Similarly, in FIGS. 11A and 11B, the housing (1001) of the printing device (100) is again depicted, and relative positions of the stack of media sheets (1002) are also depicted. In the retracted state depicted in FIG. 11A, the stack of media sheets (1002) are located a third distance (1103) under various elements of the printing device (100) and relatively out of view of the user in the negative Y direction as indicated by the Cartesian coordinate indicator (250). In one example, the distance (1103) is approximately 69 mm from the outer-most edge of the housing (1001).

In order to place the stack of media sheets (1002) in a viewable and obtainable position, the translatable output floor (440) of the finisher output bin assembly (201) is moved some distance in the positive Y direction as depicted in FIG. 11B. This results in the stack of media sheets (1002) being located a fourth distance (1104) relative to the various elements of the printing device (100), and within view and in an obtainable position relative to the position depicted in FIG. 11A. In one example, the fourth distance (1104) is approximately 19 mm past the housing (1001) of the printing device (100), resulting in approximately 88 mm of translation of the stack of media sheets (1002) in the positive Y direction and protrusion of the media sheets (1002) past the housing (1001). This also greatly improves the visibility and access of the stack of media sheets (1002) for the user.

Figure 12:
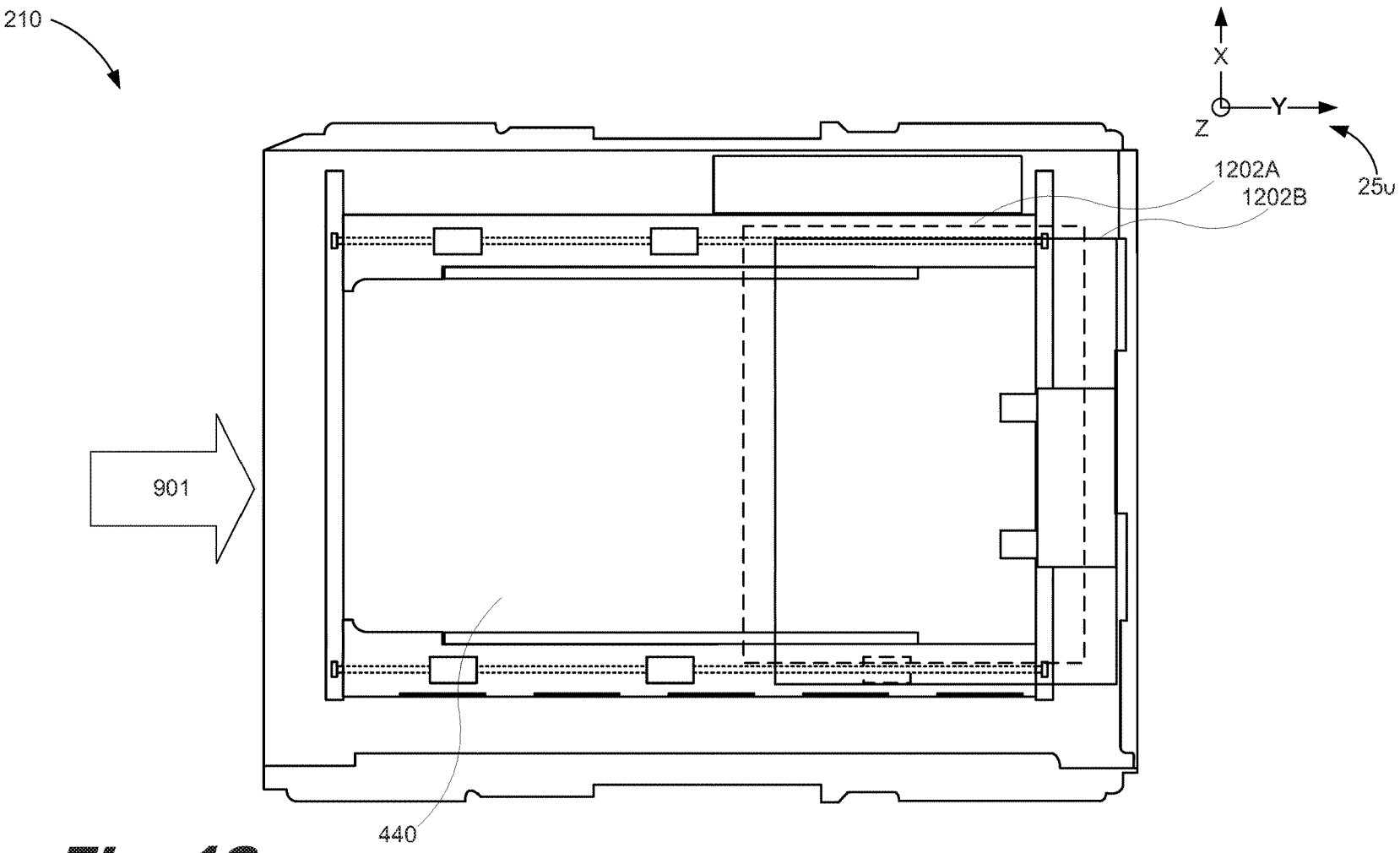
FIG. 12 is a top view of the output area of the printing device of FIG. 2 depicting the finisher output bin assembly of FIGS. 4 through 6 in a retracted state and offsetting stacks of media sheets, according to one example of the principles described herein.

FIG. 12 is a top view of the output area (210) of the printing device (100) of FIG. 2 depicting the finisher output bin assembly (201) of FIGS. 4 through 6 in a retracted state and offsetting stacks of media sheets, according to one example of the principles described herein. In some instances, more than one stack of media sheets may be deposited on the finisher output bin assembly (201). This may occur in situations where the user has requested more than one set of collated documents be printed or in instances where a user forgets to remove a first stack of media sheets from the printing device (100), and that stack of media sheets remains within the output tray (121). In these situations, the stacks of media sheets are offset from one another so that when the user obtains the stacks of media sheets from the output tray (121), the user is able to distinguish between separate stacks of media sheets using the offset of the stacks. In one example, the user may select an offset option provided by the printing device (100) to ensure that individual stacks of media sheets are offset. In another example, the printing device (100) automatically offsets the stacks. In this example, the automatic offsetting may occur in instances where stacks of media sheets were unintentionally left on the printing device (100). This provides the user with a visual and tactile clue that at least one of the offset stacks was previously printed and unintentionally left on the output tray (121).

Thus, as depicted in FIG. 12, consecutive stacks of media sheets may be offset in an offset back position (1202A) and an offset front position (1202B). In one example, the offset back position (1202A) is a home or retracted position of the translatable output floor (440) where the translatable output floor (440) is fully retracted. In another example, the offset back position (1202A) is an intermediate position between the home position and a fully extended position of the translatable output floor (440). Likewise, in one example, the offset front position (1202B) of the translatable output floor (440) may be a fully extended position of the translatable output floor (440). In another example, the offset front position (1202B) of the translatable output floor (440) is an intermediate position between the fully extended position of the translatable output floor (440) and the home position. In still another example, the offset back position (1202A) and the offset front position (1202B) are a combination of these positions.

Figure 13:
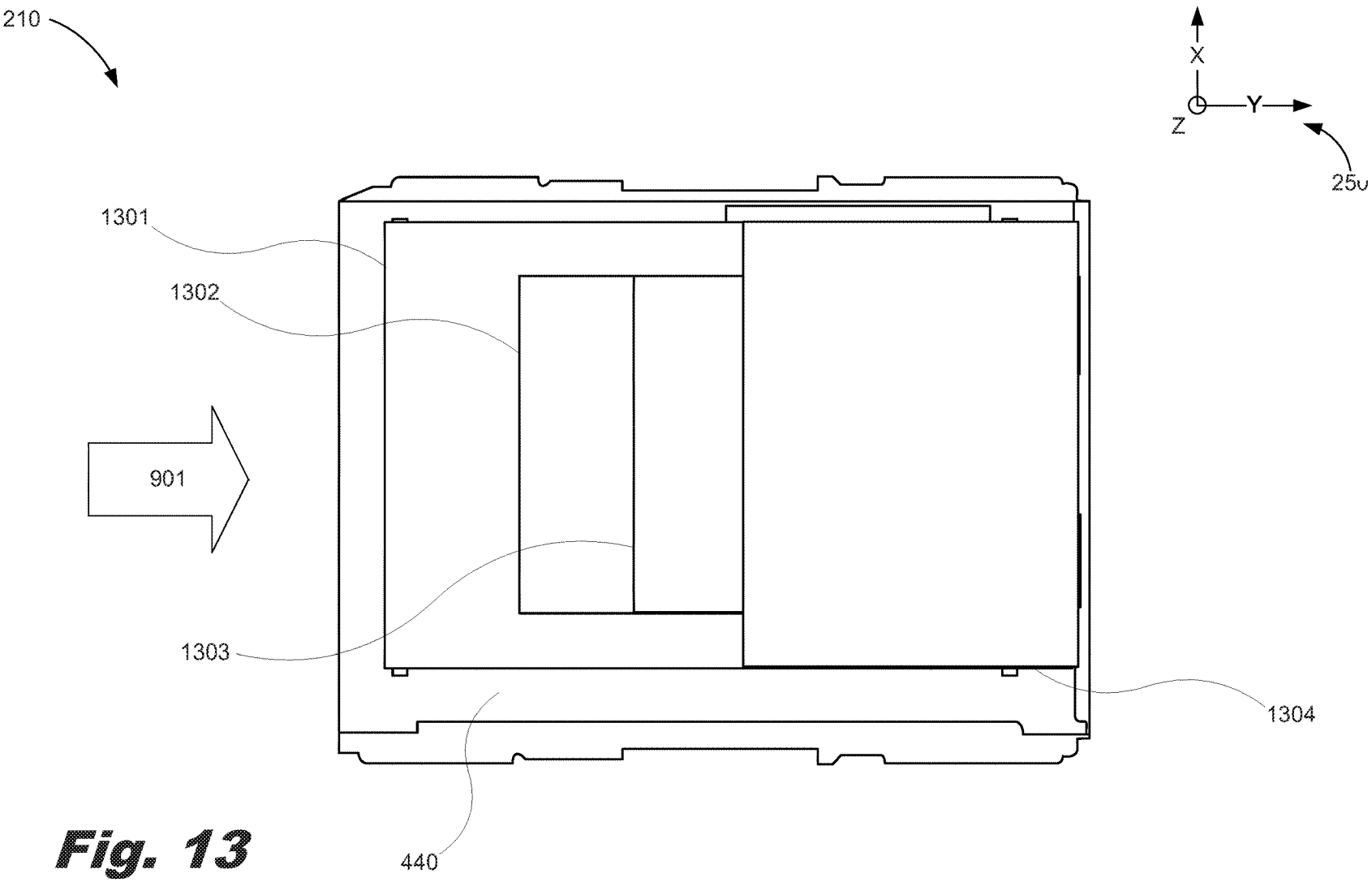
FIG. 13 is a top view of the output area of the printing device of FIG. 2 depicting orientations of a number of different sizes of media sheets, according to one example of the principles described herein.

FIG. 13 is a top view of the output area (210) of the printing device (100) of FIG. 2 depicting orientations of a number of different sizes of media sheets, according to one example of the principles described herein. In the example of FIG. 13, the translatable output floor (440) is depicted as being fully retracted in the home position. The output area (210) of the printing device (100) may be dimensioned to receive and process any number of sizes of media sheets. Examples include B/A3 (1301), legal size with a short-edge-first feed (1302), A/A4 with a short-edge-first feed (1303), and A/A4 with a long-edge-first feed (1304), among other sizes and orientations.

Figure 14:
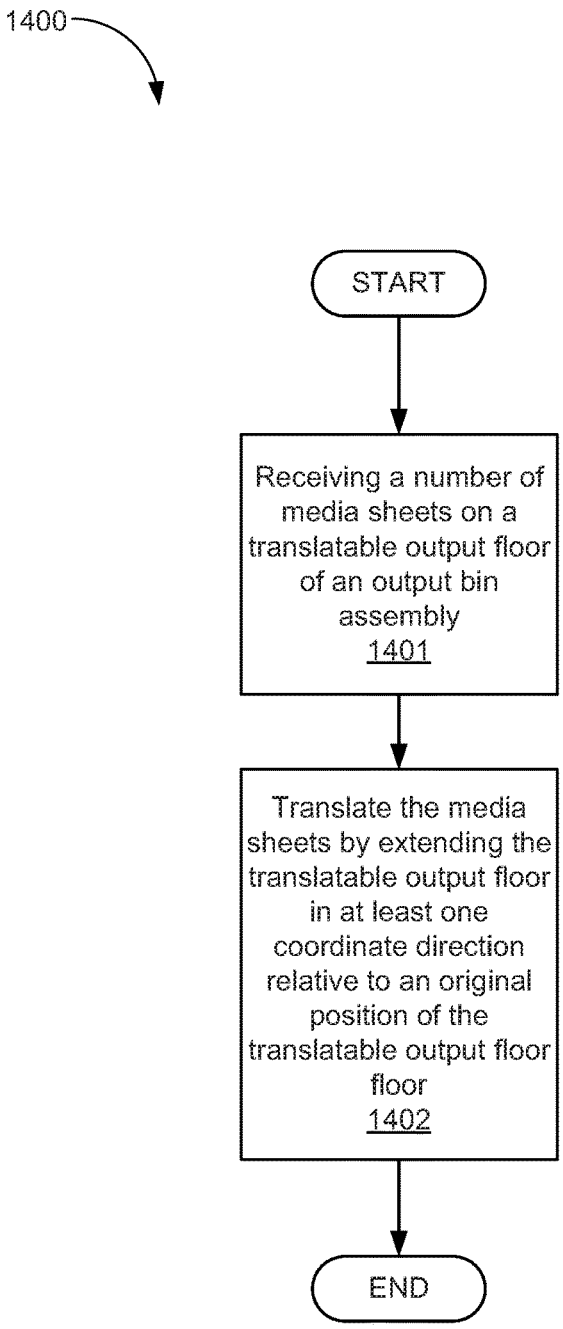
FIG. 14 is a flowchart depicting a method of providing access to printed media sheets within an output tray, according to one example of the principles described herein.

FIG. 14 is a flowchart (1400) depicting a method of providing access to printed media sheets within an output tray (121), according to one example of the principles described herein. The method may begin by receiving (block 1401) a number of media sheets on the finisher output bin assembly (201) of an output bin assembly of the output tray (121). The finisher output bin assembly (201), through activation by the controller (130) of the drive motor (408)

translates (block 1402) the media sheets by extending the translatable output floor (440) of the finisher output bin assembly (201) in at least one coordinate direction relative to an original position of the of the translatable output floor (440). In this manner, the media sheets are made visually perceptible, and physically accessible by a user. As described above, the translatable output floor (440) may be extended in at least two coordinate directions relative to the original position of the translatable output floor (440).

Figure 15:
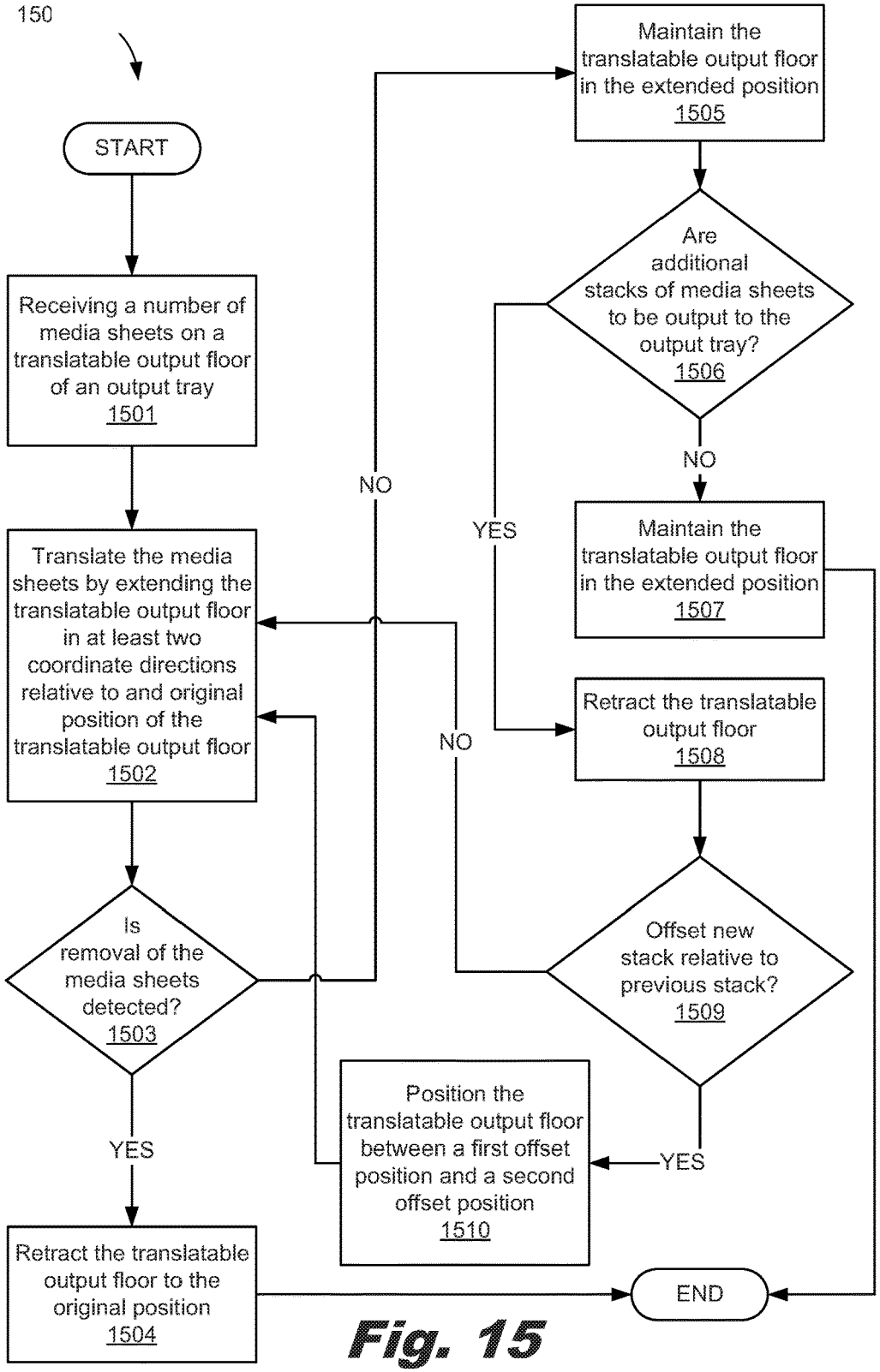
FIG. 15 is a flowchart depicting a method of providing access to printed media sheets within an output tray, according to another example of the principles described herein.

FIG. 15 is a flowchart (1500) depicting a method of providing access to printed media sheets within an output tray (121), according to another example of the principles described herein. Again, the method may begin by receiving (block 1501) a number of media sheets on the finisher output bin assembly (201) of an output tray (121). Once the document is complete, the finisher output bin assembly (201), through activation by the controller (130) of the drive motor (408), translates (block 1502) the media sheets by extending by the finisher output bin assembly (201) in at least one coordinate direction relative to an original position of the finisher output bin assembly (201). In another example, the finisher output bin assembly (201) translates (block 1502) the media sheets in at least two coordinate directions relative to an original position of the finisher output bin assembly (201) simultaneously or sequentially. In the example where the guide substrate (420) translates (block 1502) the translatable output floor (440) in a plurality of coordinate directions, the translatable output floor (440) may be moved in a single direction that is a vector of the plurality of coordinate directions.

The removal or retention of the media sheets on the finisher output bin assembly (201) is determined at block (1503). If the removal of the media sheets is detected (block 1503, determination YES), the controller (130) of the printing device (100) causes the finisher output bin assembly (201) to retract to an original or home position. Detection of media sheets on the finisher output bin assembly (201) is performed using the mirrors (701, 702) and sensor (703) depicted in FIGS. 7 and 8. If media sheets are located on the top surface of the translatable output floor (440) of the finisher output bin assembly (201), the mirrors (701, 702) are obstructed from the view of the sensor (703). This information is sent to the controller (130), and the controller (130) act accordingly. For example, if the removal of the media sheets is detected by the sensor (703) and the mirrors (701, 702) by the sensor (703) being able to detect the mirrors, the controller (130) of the printing device (100) causes the finisher output bin assembly (201) to retract to an original or home position enabling improved viewing and access to the lower bin (204). However, if the sensor (703) does not detect the mirrors (701, 702), then removal of media sheets from the translatable output floor (440) of the finisher output bin assembly (201) is not detected (block 1503, determination NO), and the controller (130) ensures that the translatable output floor (440) of the finisher output bin assembly (201) is maintained (block 1505) in an extended position. This allows a user ample opportunity to see and obtain the stacks of media sheets.

A determination (block 1506) is made as to whether additional stacks of media sheets are to be output to the output tray (121). In instances where multiple stacks of media sheets are to be output to the output tray (121), consecutive stacks of media sheets are offset from one another as described above in connection with FIG. 12. As mentioned above, offsetting of consecutive media sheets may be performed when the print job requested by the user includes the output of a plurality of stacks of media sheets. Further, offsetting of consecutive media sheets may be performed when a stack of media sheets from a previous print job is left on the output tray (121). In these examples, if additional stacks of media sheets are to be output to the output tray (121) (block 1506, determination YES), then the translatable output floor (440) of the finisher output bin assembly (201) is retracted (block 1508) to receive the next stack of media sheets. At block 1509, it is determined whether the additional stacks of media sheets is to be offset from the previous stack or stacks of media sheets. In one example, determination 1509 is based on whether a user selected an offset function of the printing device (100). If the additional stack is to be offset (block 1509, determination YES), then the printing device (100) positions (block 1510) the translatable output floor (440) in an offset position relative to the stack of media sheets already existing on the translatable output floor (440). As the additional stacks of media sheets are deposited on the translatable output floor (440), the translatable output floor (440) of the finisher output bin assembly (201) is translated (block 1509) between the first offset position such as the offset back position (1202A) and second offset position such as the offset front position (1202B) depicted in FIG. 12. If the additional stack is not to be offset (block 1509, determination NO), or in response to completion of block 1510, the method (1500) loops to block 1502 to allow for the plurality of stacks of media to be translated by extending the finisher output bin assembly (201) to an extended position to allow for a user to visually detect and physically access the stacks of media sheets.

If no additional stacks of media sheets are to be output to the output tray (121) (block 1506, determination NO), then the translatable output floor (440) of the finisher output bin assembly (201) is maintained (block 1507) in the extended position. Again, this allows a user ample opportunity to see and obtain the stacks of media sheets.

Based on the method of FIG. 15, certain conditions are made clear. First, if no stacks of media sheets are in the output tray (121), then the sensor (703) can detect the mirrors (701, 702), and the translatable output floor (440) of the finisher output bin assembly (201) is retracted to an original or home position. In other words, the translatable output floor (440) is in a retracted state, and is maintained in that position while the stacks of media sheets are processed by the finisher device (202) and dropped to the translatable output floor (440). Once the stacks of media sheets are dropped to the translatable output floor (440), the translatable output floor (440) is extended.

Second, if no stacks of media sheets are located in the output tray (121) as detected by the sensor (703) and mirrors (701, 702) and the translatable output floor (440) is in an extended state, then the controller (130) causes the translatable output floor (440) to be retracted. Third, if the printing device (100) is waking up from a sleep state or otherwise being turned on, a number of stacks of media sheets are located in the output tray (121), and the translatable output floor (440) of the finisher output bin assembly (201) is in a retracted state in the original or home position, then the translatable output floor (440) is extended to allow a user to see and obtain the stacks of media sheets.

Fourth, if a number of stacks of media sheets are located in the output tray (121) and the translatable output floor (440) of the finisher output bin assembly (201) is extended, then the translatable output floor (440) is maintained in the extended state. In this example, if the finisher device (202) is collecting and processing media sheets, the translatable output floor (440) is maintained in an extended state until the finisher device (202). When the finisher device (202) completes its processes, the translatable output floor (440) retracts to accept the newly-dropped stack of media sheets. Thereafter, the translatable output floor (440) again extends to allow the user to see and obtain the stacks of media sheets located on the translatable output floor (440).

Fifth, in the examples described above, if an offsetting of stacks of media sheets is either selected by the user or automatically performed, the translatable output floor (440) alternates between the offset back position (1202A) and the offset front position (1202B).

Aspects of the present systems and methods are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the controller (130) of the printing device (100) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a system for presenting media sheets. The system includes an output tray, and a finisher output bin assembly. The finisher output bin assembly includes a translatable output floor, a guide substrate coupled to the translatable output floor to guide the translatable output floor relative to the guide substrate in at least two coordinate directions, and an output structure mechanically coupled to the translatable output floor to drive the translatable output floor relative to the guide substrate. This system provides for (1) output compatibility with systems that perform a number of finishing processes such as alignment, stapling, and stacking, of partially dried inkjet output; (2) visual and physical access to output provided by a finisher device; (3) visual and physical cues that output is located in the output tray on the finisher output bin assembly and ready to be collected; (4) minimal visual and physical distraction from a first output tray by extending the finisher output bin assembly if media is present in the second output tray; (5) good visual and physical accessibility to the first output tray when the finisher output bin assembly of the second output tray is either retracted or extended; (6) job offset in at least 2 axes which enables separation of consecutively output stacks of media sheets on any of the four edges of the media sheets, among others.

The preceding description has been presented to illustrate and describe examples of the principles described. This description is not intended to be exhaustive or to limit these principles to any precise form disclosed. Many modifications and variations are possible in light of the above teaching.

What is claimed is:

1. A system for presenting media sheets comprising:
an output tray; and
an output bin assembly positioned below a finishing device of the output tray comprising:
a translatable output floor;
a guide substrate coupled to the translatable output floor to guide the translatable output floor relative to the guide substrate in at least two coordinate directions; and
an output structure mechanically coupled to the translatable output floor to drive the translatable output floor relative to the guide substrate.

2. The system of claim 1, wherein the output structure comprises:
a drive motor; and
a gear rotatably coupled to the drive motor.

3. The system of claim 2, wherein at least one drive belt mechanically couples the drive motor to the gear to rotate the gear.

4. The system of claim 1, further comprising:
a number of guide surfaces defined in the guide substrate; and
a number of guide pins formed on the translatable output floor,
wherein the guide pins movably couple the translatable output floor to the guide substrate.

5. The system of claim 4, wherein the guide surfaces define the direction of movement of the translatable output floor relative to the guide substrate.

6. The system of claim 1, further comprising a number of rollers coupled to a surface of the guide substrate that interface with the translatable output floor to reduce friction between the guide substrate and the translatable output floor.

7. The system of claim 1, further comprising:
a number of mirrors disposed on the translatable output floor; and
a number of sensors coupled to the system,
wherein the sensors detect the position of the translatable output floor, the presence of media sheets on the translatable output floor, the position of the media sheets on the translatable output floor, a number of offset positions of the translatable output floor, or combinations thereof.

8. The system of claim 7, further comprising a controller to control the position of the translatable output floor based at least partially on information provided by the sensors.

9. An output bin assembly to translate a number of media sheets within an output tray comprising:
a guide substrate coupled to a translatable output floor to guide the translatable output floor relative to the guide substrate in at least two coordinate directions;
an output structure comprising at least one pinion gear protruding through the guide substrate and mechanically coupling to a rack gear formed on the translatable output floor; and
a drive motor coupled to the pinion gear to drive the translatable output floor relative to the guide substrate.

10. The output bin assembly of claim 9, further comprising a number of track systems defined between the guide substrate and the translatable output floor that define the at least two coordinate directions of movement of the translatable output floor relative to the guide substrate.

11. The output bin assembly of claim 9, further comprising a retention device coupled to the guide substrate to mesh the rack gear with the pinion gear.

12. A method for providing access to printed media sheets within an output tray comprising:
receiving a number of media sheets on a translatable output floor of an output bin assembly; and translating the media sheets by extending a translatable output floor in at least two coordinate directions relative to an original position of the translatable output floor.

13. The method of claim 12, further comprising alternating a location of the translatable output floor between a first offset position and a second offset position to offset consecutive print media stacks.

14. The method of claim 12, further comprising:

retracting the translatable output floor to the original position if removal of the media sheets is detected by a number of sensors; and maintaining the translatable output floor in the extended position if the media sheets are detected on the translatable output floor by the sensors.

15. The method of claim 14, further comprising retracting the translatable output floor to the original position if additional stacks of media sheets are outputted to the output tray.

* * * * *